US007137272B2

(12) United States Patent
Park et al.

(10) Patent No.: US 7,137,272 B2
(45) Date of Patent: Nov. 21, 2006

(54) REFRIGERATOR HAVING DISPENSER

(75) Inventors: Ji-Young Park, Seoul (KR); Kyung-Ah Cho, Seoul (KR); Jong-Woon Park, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 174 days.

(21) Appl. No.: 10/930,833

(22) Filed: Sep. 1, 2004

(65) Prior Publication Data

US 2005/0072178 A1 Apr. 7, 2005

(30) Foreign Application Priority Data

Sep. 6, 2003 (KR) ..... 10-2003-0062360

(51) Int. Cl.
*B67D 5/62* (2006.01)

(52) U.S. Cl. ..... 62/389; 222/146.6; 312/405

(58) Field of Classification Search ..... 62/344, 62/389–400; 222/192, 146.6; 312/292, 312/405

See application file for complete search history.

(56) References Cited

U.S. PATENT DOCUMENTS 3,602,007 A * 8/1971 Drieci ..... 62/344
3,643,464 A * 2/1972 Hilliker et al. ..... 62/344
3,747,363 A * 7/1973 Grimm ..... 62/377
3,883,204 A * 5/1975 Prada et al. ..... 312/273
4,087,140 A * 5/1978 Linstromberg ..... 312/292
4,095,439 A * 6/1978 Linstromberg ..... 62/344
4,209,999 A * 7/1980 Falk et al. ..... 62/344
4,306,757 A * 12/1981 Horvay et al. ..... 312/292
5,139,183 A * 8/1992 Buchser et al. ..... 222/547
5,971,213 A * 10/1999 Lee ..... 222/146.6
2003/0132690 A1* 7/2003 Shin et al. ..... 312/405

* cited by examiner

*Primary Examiner*—William E. Tapolcai
(74) *Attorney, Agent, or Firm*—Fleshner & Kim, LLP

(57) ABSTRACT

Disclosed is a refrigerator having a dispenser comprising: a dispenser case mounted at one side of a refrigerator door; a cold water faucet and a hot water faucet provided in the dispenser case and from which cold water and hot water are supplied; and a dispenser door for opening and closing the dispenser case. In this construction, a hot water button is prevented from being pressed by a child by mistake and thus a child is prevented from getting burned by hot water from the hot water faucet, thereby enhancing a stability. Also, when a cup or a container becomes hot while or after the user gets hot water from the hot water faucet in the cup or the container, the cup or the container can be placed on the dispenser door thereby to enhance the user's convenience.

19 Claims, 7 Drawing Sheets

REFRIGERATOR HAVING DISPENSER

BACKGROUND OF THE INVENTION

1. Field of the Invention

The present invention relates to a refrigerator, and more particularly, to a refrigerator having a dispenser capable of enhancing a stability of the dispenser for supplying cold water or hot water and capable of utilizing the dispenser more conveniently.

2. Description of the Conventional Art

Generally, a refrigerator is provided with a refrigerating cycle system therein. A freezing chamber and a chilling chamber of the refrigerator are maintained as a cold state as cool air is generated from an evaporator constituting the refrigerating cycle system and the generated cool air circulates in the freezing chamber, the chilling chamber, etc. Food is stored in the freezing chamber, the chilling chamber, etc.

The refrigerator is classified as various types according to a method for circulating cool air, a position of the freezing chamber and the chilling chamber, and a construction of the evaporator.

In order to satisfy a consumer's various demands, the refrigerator is provided with various equipments. One of them is a dispenser by which a user can enjoy cold water or hot water from outside without opening a refrigerator door.

FIG. 1 is a perspective view showing one embodiment of a refrigerator having a dispenser in accordance with the conventional art, and FIG. 2 is a perspective view showing the dispenser of the refrigerator in accordance with the conventional art.

As shown, the refrigerator having a dispenser comprises: a refrigerator body 100 having a freezing chamber (not shown) and a chilling chamber (not shown) therein; and a refrigerator door 200 rotatably mounted at one side of the refrigerator body 100, for opening and closing the freezing chamber and the chilling chamber.

The refrigerator body 100 is provided with not only a refrigerating cycle system, but also a cool air circulating passage for circulating cool air generated at the refrigerating cycle system into the freezing chamber or the chilling chamber, etc.

A dispenser is provided at one side of the refrigerator door 200. The dispenser includes: a dispenser case 310 having a certain area and depth and insertion-coupled to one side of the refrigerator door; a cold water faucet 320 mounted in the dispenser for supplying cold water; a cold water button 330 for opening and closing the cold water faucet 320 in order to supply cold water through the cold water faucet 320; a hot water faucet 340 mounted in the dispenser for supplying hot water; a hot water button 350 for opening and closing the hot water faucet 340; and a dispenser control box 360 mounted at the dispenser case 310.

A front surface of the dispenser case 310 is opened, and a remaining water accommodating portion 311 for temporarily storing water leaked from the cold water faucet 320 and the hot water faucet 340 or dropped by a user is provided at a lower surface of the dispenser case 310.

The cold water faucet 320 and the hot water faucet 340 are respectively formed as a pipe shape having a certain length, and are arranged in parallel each other. The cold water button 330 and the hot water button 350 are respectively installed at a rear side of the cold water faucet 320 and the hot water faucet 340.

Function keys and a display portion are provided at the front surface of the dispenser control box 360.

A water tank (not shown) is provided in the refrigerator body 100, and the water tank is connected to an external water supplying source such as a tap by a connection hose 400. The water tank is connected to the dispenser by a water supplying hose (not shown), and the water supplying hose is arranged in the refrigerator door 200.

In the refrigerator having the dispenser, a user stores food in the freezing chamber or the chilling chamber with opening the refrigerator door 200.

In case of requiring cold water or hot water, the user uses the dispenser provided at the outside of the refrigerator door 200 without opening the refrigerator door 200. That is, in case of requiring cold water, the user positions a cup or a container at a lower portion of the cold water faucet 320 and then presses the cold water button 330 thus to contain cold water from the cold water faucet 320 in the cup or the container. Also, in case of requiring hot water, the user positions a cup or a container at a lower portion of the hot water faucet 340 and then presses the hot water button 350 thus to contain hot water from the hot water faucet 340 in the cup or the container.

However, according to the refrigerator having the dispenser, the dispenser is installed at the front surface of the refrigerator door 200 as an opened state.

Therefore, in case that a child presses the hot water button 350 by mistake, the child gets a burn by the hot water from the hot water faucet 340.

Also, since an installation space of the dispenser for supplying hot water or cold water is narrow, the user has to hold a hot cup continuously in case of getting hot water thereby to cause an inconvenience.

SUMMARY OF THE INVENTION

Therefore, an object of the present invention is to provide a refrigerator having a dispenser capable of enhancing a stability of the dispenser for supplying cold water or hot water and capable of utilizing the dispenser more conveniently.

To achieve these and other advantages and in accordance with the purpose of the present invention, as embodied and broadly described herein, there is provided a refrigerator having a dispenser comprising: a dispenser case mounted at one side of a refrigerator door; faucets provided in the dispenser case and from which water is supplied; and a dispenser door for opening and closing the dispenser case.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a refrigerator having a dispenser according to the present invention will be explained with reference to the attached drawings in more detail.

Figure 1:
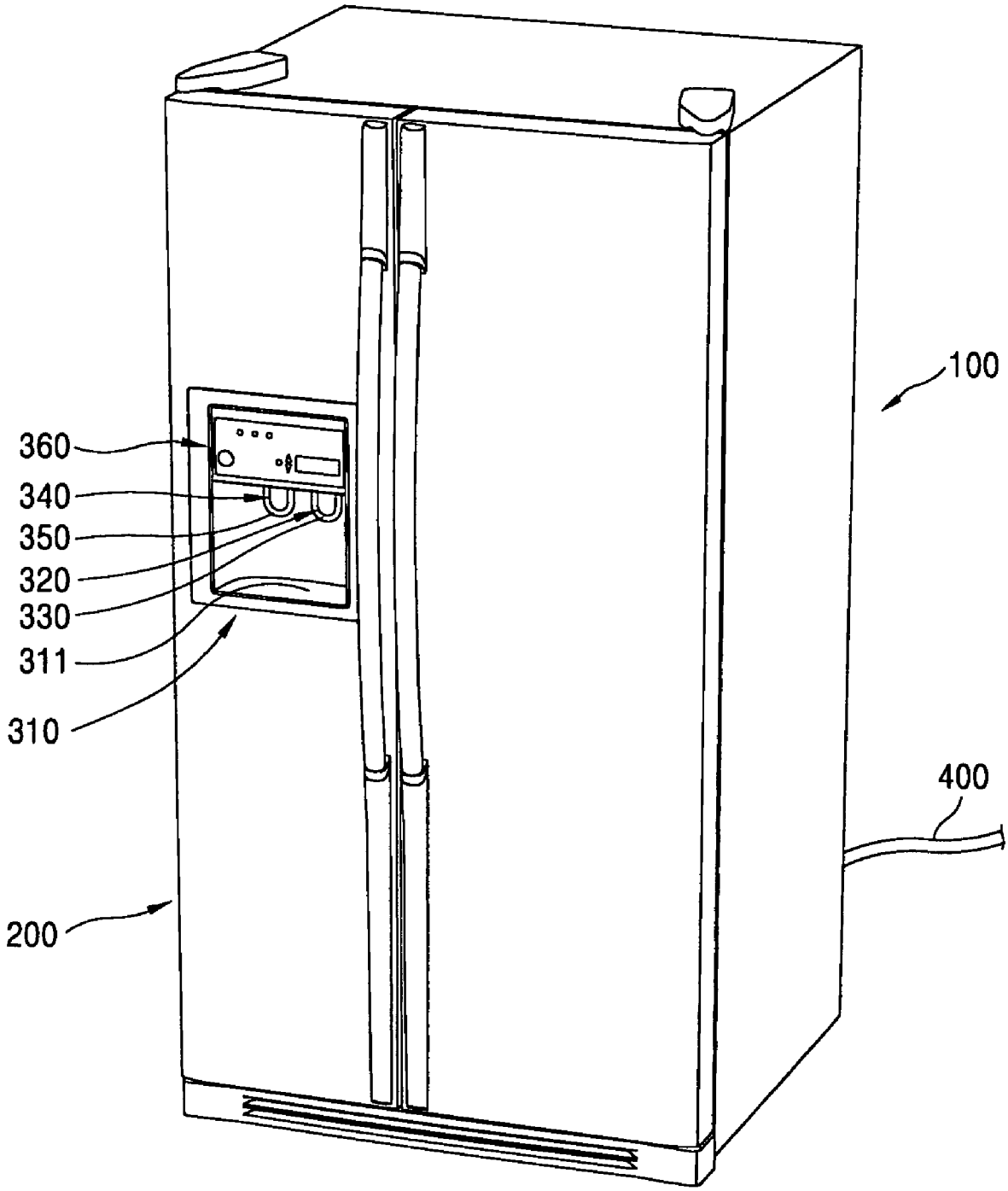
FIG. 1 CONVENTIONAL ART
FIG. 1 is a perspective view showing one embodiment of a refrigerator having a dispenser in accordance with the conventional art.
Figure 2:
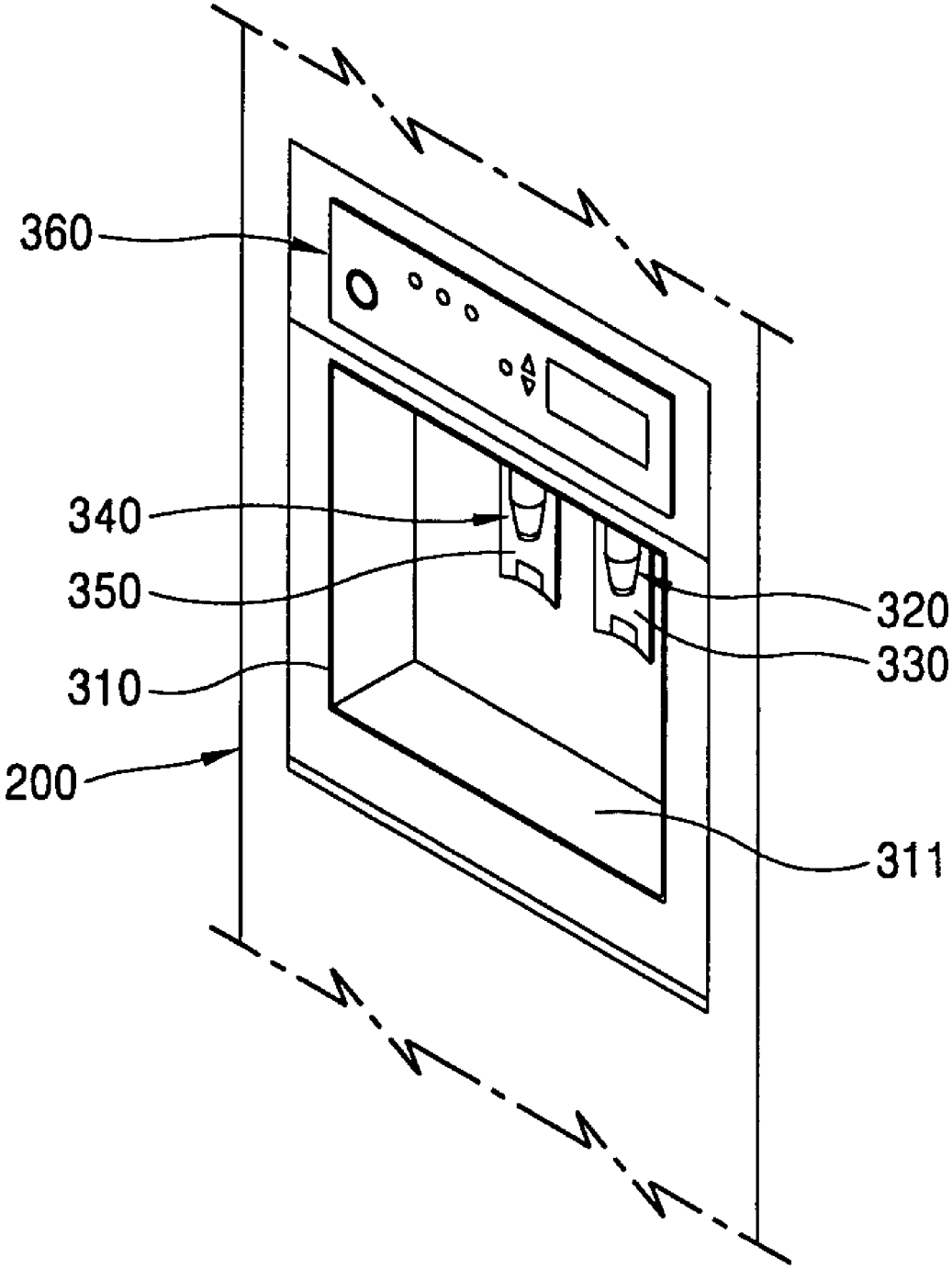
FIG. 2 CONVENTIONAL ART
FIG. 2 is a perspective view showing the dispenser of the refrigerator in accordance with the conventional art.
Figure 3:
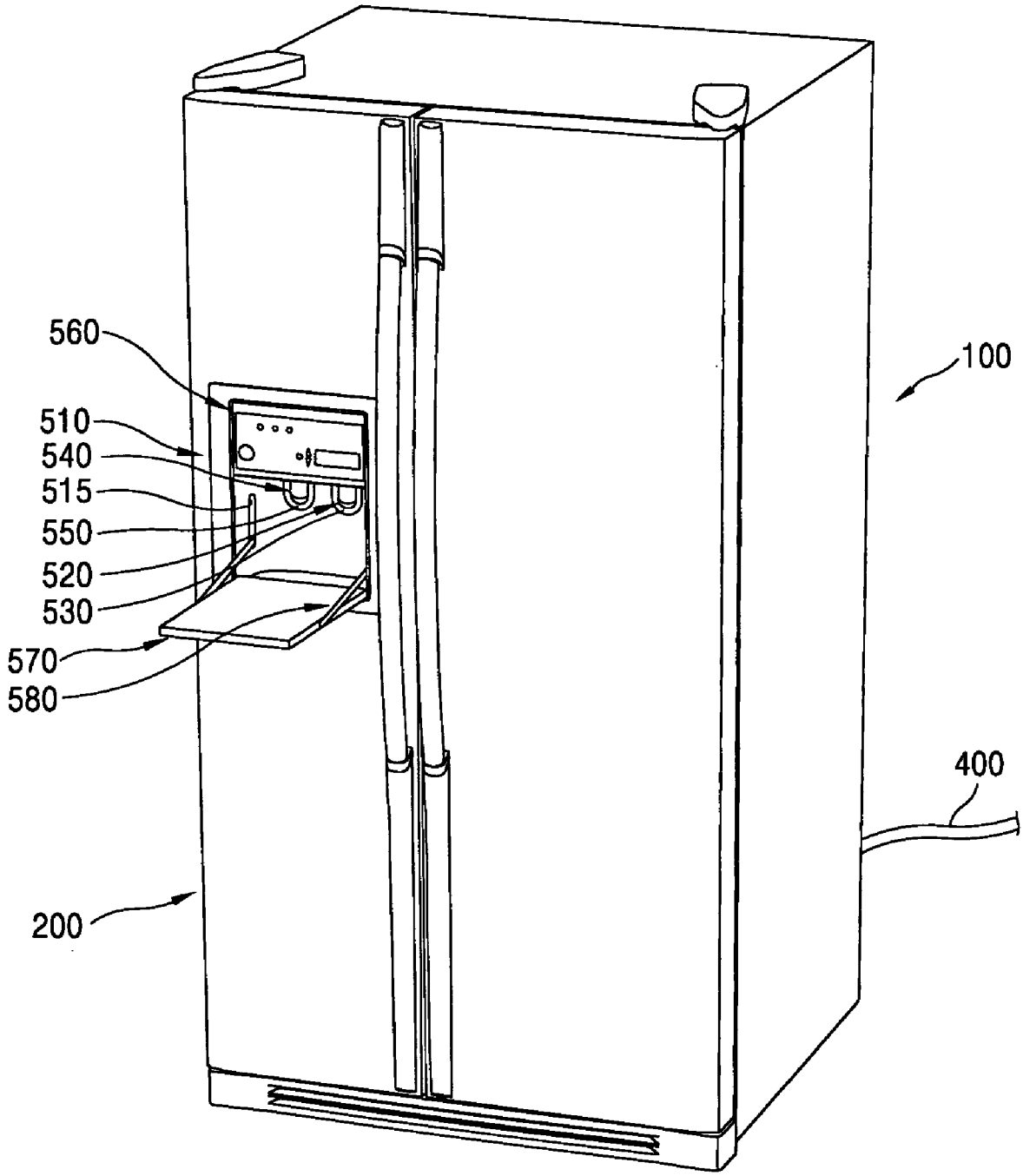
FIG. 3 is a perspective view showing a refrigerator having a dispenser according to the present invention.
Figure 4:
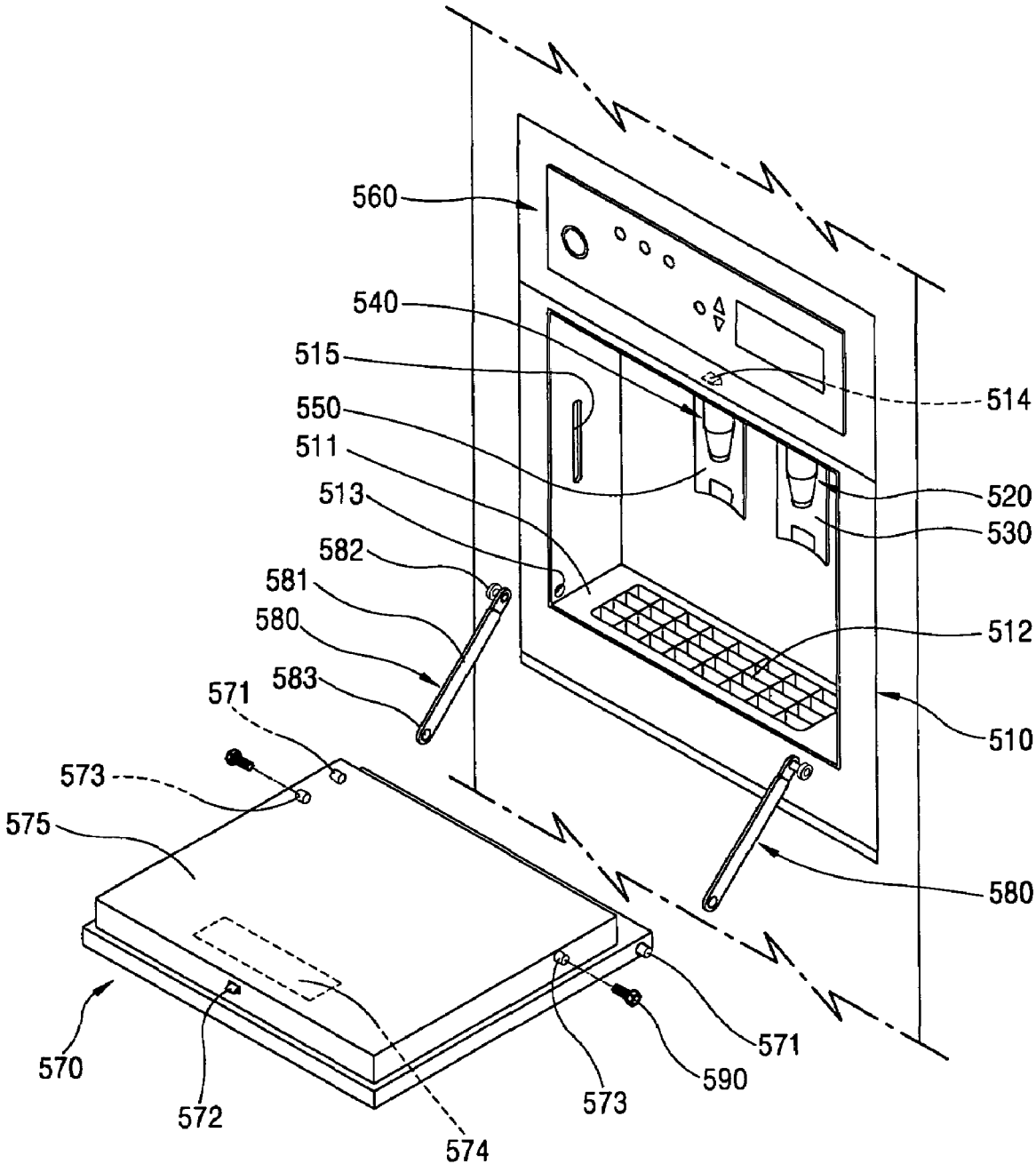
FIG. 4 is a perspective view showing the dispenser of the refrigerator by partially disassembling according to the present invention.

FIG. 3 is a perspective view showing a refrigerator having a dispenser according to the present invention, and FIG. 4 is a perspective view showing the dispenser of the refrigerator by partially disassembling according to the present invention. The same reference numerals will be given to the same parts as those of the conventional art.

As shown, a refrigerator having a dispenser according to the present invention comprises: a refrigerator body 100 having a freezing chamber and a chilling chamber; refrigerator doors 200 respectively coupled to one side of the refrigerator body 100, for opening and closing the freezing chamber and the chilling chamber; a dispenser case 510 mounted at one side of the refrigerator door 200; a cold water faucet 520 and a hot water faucet 540 provided in the dispenser case 510 and from which cold water and hot water are supplied; and a dispenser door 570 for opening and closing the dispenser case 510.

The refrigerator body 100 is provided with not only a refrigerating cycle system, but also a cool air circulating passage for circulating cool air generated at the refrigerating cycle system into the freezing chamber or the chilling chamber, etc.

The dispenser case 510 is preferably mounted at the refrigerator door 200 for opening and closing the freezing chamber.

The dispenser case 510 has one opened side and a hexagon shape, and is insertion-coupled to a front surface of the refrigerator door 200. A remaining water accommodating portion 511 is provided at a lower portion of the dispenser case 510, and a base 512 is positioned at the remaining water accommodating portion 511.

The cold water faucet 520 and the hot water faucet 540 are respectively formed as a pipe shape having a certain length, and are installed at a rear upper surface of the dispenser case 510.

The cold water faucet 520 and the hot water faucet 540 are arranged in parallel each other, and are respectively provided with a cold water button 530 and a hot water button 550 at a rear side thereof. When the cold water button 530 is pressed, cold water is supplied from the cold water faucet 520. Likewise, when the hot water button 550 is pressed, hot water is supplied from the hot water faucet 540.

The dispenser door 570 is formed as a square shape having a certain thickness in order to open and close the opened side of the dispenser case 510, and four lateral surfaces are stepped. The dispenser door 570 is rotatably coupled to a lower portion of the dispenser case 510 by a coupling means in order to open and close the opened side of the dispenser case 510 upwardly and downwardly.

The coupling means includes: stopping grooves 513 formed at inner wall surfaces of both sides of the dispenser case 510; and hinge protrusions 571 protruded at outer wall surfaces of both sides of the dispenser door 570 thus to be rotatably inserted into the stopping grooves 513. The stopping grooves 513 are formed at a lower portion of the inner wall surfaces of both sides of the dispenser case 510, and the hinge protrusions 571 are formed at a lower portion of the outer wall surfaces of both sides of the dispenser door 570.

A detachable protrusion 572 is provided at an upper lateral surface, and a detachable protrusion groove 514 for mounting the detachable protrusion 572 is provided at an inner wall of the dispenser case 510.

A fixation means is provided at the dispenser door 570 and the dispenser case 510 so that the dispenser door 570 can be fixed to the refrigerator door 200 with an angle of 90° in a state that the dispenser door 570 is opened.

The fixation means includes: guide grooves 515 formed at inner wall surfaces of both sides of the dispenser case 510 with a certain length and width; and supporting members 580 having a certain length and of which one side is movably coupled to the guide groove 515 and another side is rotatably coupled to a lateral surface of the dispenser door 570.

The guide groove 515 has a perpendicular longitudinal direction.

The supporting member 580 is composed of: a rod portion 581 having a certain thickness and length; a stopping protrusion 582 protruded at one end of the rod portion 581 thus to be slidably inserted into the guide groove 515; and a penetration hole 583 formed at another end of the rod portion 581. A fixation protrusion 573 for rotatably coupling the penetration hole 583 of the supporting member is formed at outer wall surfaces of both sides of the dispenser door 570. A screw 590 for preventing the supporting member 580 from being separated is coupled to the fixation protrusion 573.

When the dispenser door 570 is closed, the stopping protrusion 582 of the supporting member is positioned at an upper portion of the guide groove 515. Also, when the dispenser door 570 is opened, the stopping protrusion 582 of the supporting member is positioned at a lower portion of the guide groove 515. According to this, the stopping protrusion 582 of the supporting member supports the dispenser door 570.

A hand grip 574 is provided at an outer lateral surface of the dispenser door 570. The hand grip 574 is formed as a groove having a certain area, and is provided with a stopping jaw at one side thereof.

A base 575 formed of a plane for placing a cup, a tool, etc. thereon at the time of opening the dispenser door 570 is provided at an inner lateral surface of the dispenser door 570.

Figure 5:
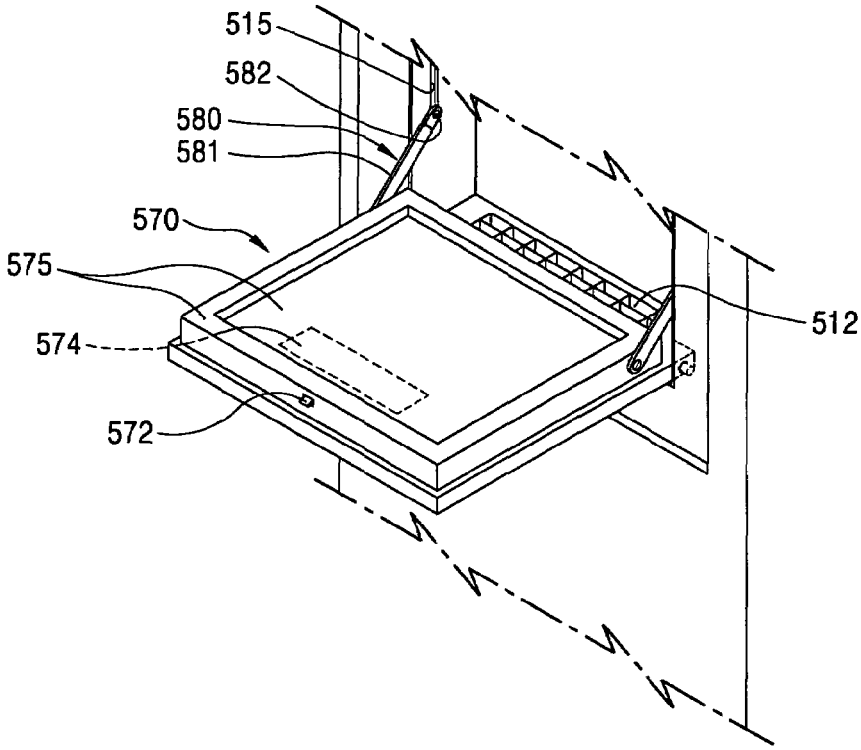
FIGS. 5 and 6 are perspective views respectively showing a modification example of a dispenser door base of the refrigerator having a dispenser according to the present invention.

As a modification example of the base 575, as shown in FIG. 5, the inner lateral surface of the dispenser door 570 is formed as a plane, and a square protrusion having a certain height is formed at the edge of the inner lateral surface thereof.

Figure 6:
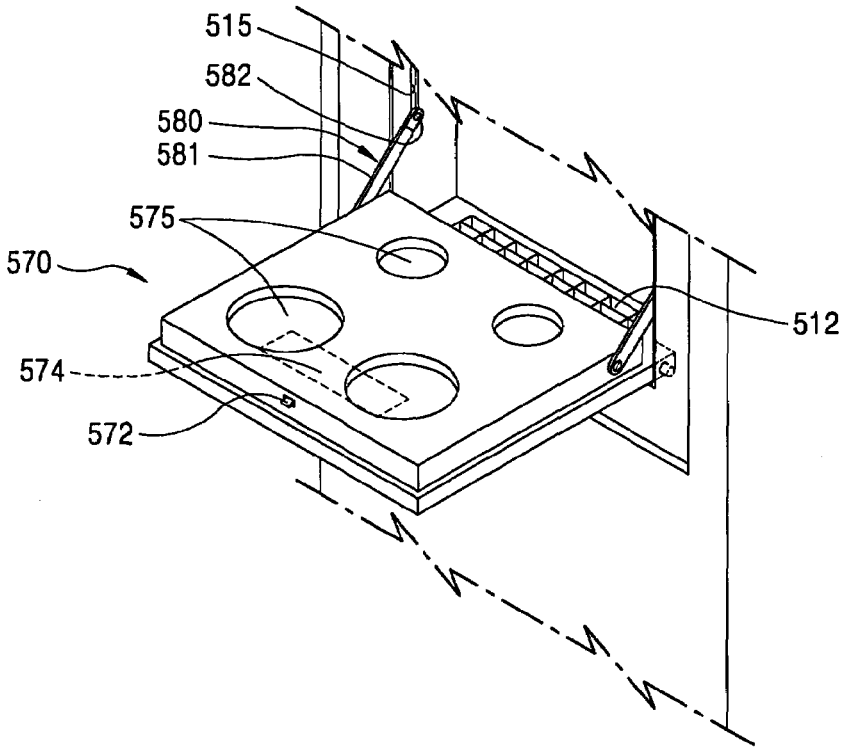

As another modification example of the base, as shown in FIG. 6, a plurality of circular grooves having a certain depth are formed at the inner lateral surface of the dispenser door 570.

The base can have various shapes.

A control box 560 for controlling the dispenser is insertion-coupled to the refrigerator door 200 positioned at the upper side of the dispenser case 510. Function keys and a display portion are provided at the front surface of the dispenser control box 560.

A water tank (not shown) is provided in the refrigerator body 100, and the water tank is connected to an external water supplying source such as a tap by a connection hose 400. The water tank is connected to the dispenser by a water supplying hose, and the water supplying hose is arranged in the refrigerator door 200.

Hereinafter, an operation effect of the refrigerator having a dispenser according to the present invention will be explained as follows.

In the refrigerator having the dispenser, a user stores food in the freezing chamber or the chilling chamber with opening the refrigerator doors 200.

In case of requiring cold water or hot water, the user uses the dispenser provided at the outside of the refrigerator door 200 without opening the refrigerator doors 200.

Figure 7:
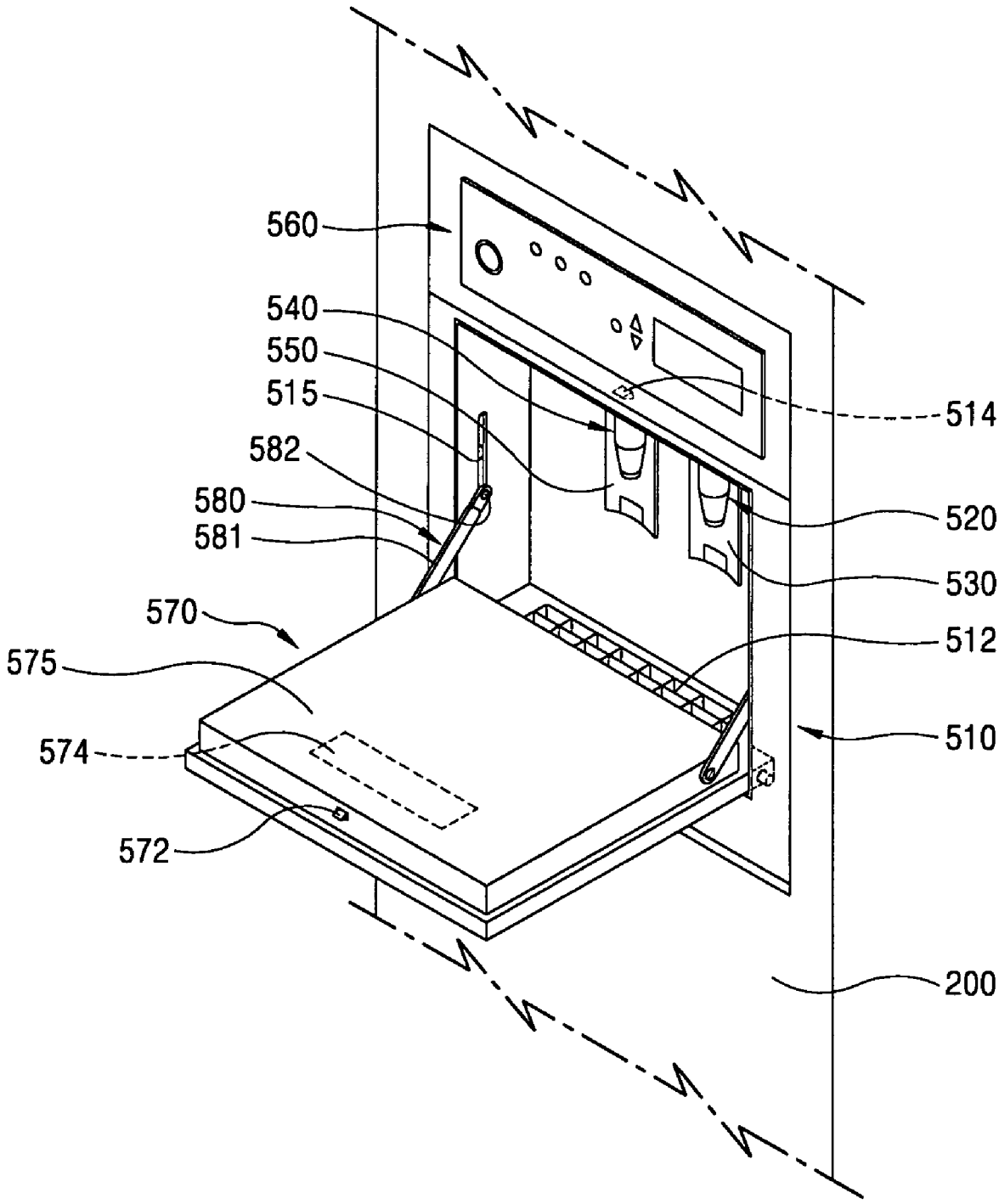
FIGS. 7 and 8 are perspective views respectively showing an operational state of the refrigerator having a dispenser according to the present invention.

Also, in case of requiring cold water or hot water, as shown in FIG. 7, the user rotates the dispenser door 570 by serving a coupling means as a shaft thereby to open the dispenser door from an upper direction to a lower direction. When the dispenser door 570 becomes opened, the dispenser door 570 is fixed to the refrigerator door 200 with an angle of 90° and thereby the dispenser door 570 is positioned as a horizontal state.

Then, a cup or a container is placed at a lower position of the cold water faucet 520 or the hot water faucet 540, and subsequently, the cold water button 530 or the hot water button 550 is pressed thereby to get cold water or hot water from the cold water faucet 520 or the hot water faucet 540 in the cup or the container.

When the cup or the container becomes hot while or after the user gets hot water from the hot water faucet 540 in the cup or the container, the cup or the container can be placed on the base 575 of the dispenser door. When the base of the dispenser door is provided with an edge protrusion or circular grooves, the cup or the container can be placed on the dispenser door more stably.

Figure 8:
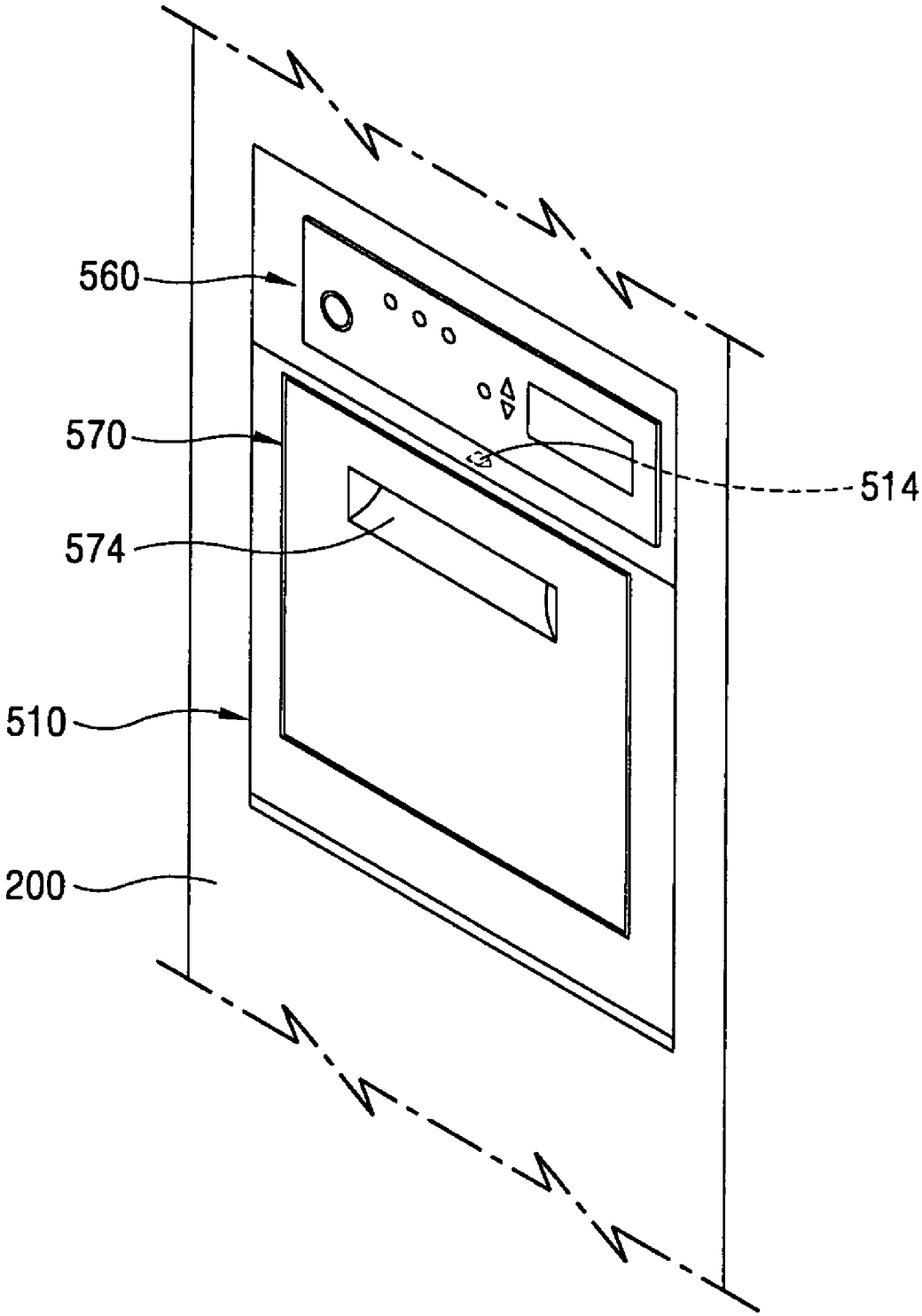

As shown in FIG. 8, after getting cold water or hot water in the cup or the container, the dispenser door 570 is upwardly pushed thereby to close the opened part of the dispenser case 510. According to this, the cold water faucet 520 and the hot water faucet 540 are not exposed to outside.

Since the cold water faucet 520 and the hot water faucet 540 are not exposed to outside as the dispenser door 570 is closed, the hot water button 550 is prevented from being pressed by a child by mistake.

As aforementioned, in the refrigerator having a dispenser of the present invention, the hot water button 550 is prevented from being pressed by a child by mistake. Therefore, a child is prevented from getting burned by hot water from the hot water faucet 540 thus to enhance a stability.

Also, when the cup or the container becomes hot while or after the user gets hot water from the hot water faucet 540 in the cup or the container, the cup or the container can be placed on the base 575 of the dispenser door. According to this, a utilization degree of a space is increased thus to enhance the user's convenience.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A refrigerator having a dispenser, comprising:

a dispenser case mounted at one side of a refrigerator door;

faucets provided in the dispenser case from which water is supplied; and a dispenser door for opening and closing the dispenser case, wherein the dispenser door is provided with a base on which a cup or tool can be placed at the time of opening the dispenser door at an inner lateral surface thereof, and wherein the base is formed as a plane at the inner lateral surface, and a protrusion having a certain height is formed at an edge of the inner lateral surface thereof.

2. The refrigerator of claim 1, wherein the dispenser door is rotatably coupled to a lower portion of the dispenser case by a coupling means in order to open and close the dispenser case upwardly and downwardly.

3. The refrigerator of claim 2, wherein the coupling means includes:

stopping grooves formed at inner wall surfaces of both sides of the dispenser case; and hinge protrusions protruded at outer wall surfaces of both sides of the dispenser door thus to be rotatably inserted into the stopping grooves of the dispenser case.

4. The refrigerator of claim 1, wherein a detachable protrusion is provided at an upper lateral surface of the dispenser door, and a detachable protrusion groove for mounting the detachable protrusion is provided at an inner wall of the dispenser case.

5. The refrigerator of claim 1, wherein the dispenser door and the dispenser case are provided with a fixation means so that the dispenser door can be fixed to the refrigerator door with an angle of 90° in a state that the dispenser door is opened.

6. The refrigerator of claim 5, wherein the fixation means includes:

guide grooves formed at inner wall surfaces of both sides of the dispenser case with a certain length and width; and supporting members having a certain length and of which one side is movably coupled to the guide groove and another side is rotatably coupled to a lateral surface of the dispenser door.

7. The refrigerator of claim 6, wherein the guide groove has a perpendicular longitudinal direction.

8. The refrigerator of claim 1, wherein the dispenser door is provided with a hand grip at an outer lateral surface thereof.

9. The refrigerator of claim 1, wherein the base is provided with a plurality of circular grooves having a certain depth at the inner lateral surface of the dispenser door.

10. The refrigerator of claim 1, wherein the faucets consist of a cold water faucet from which cold water is supplied and a hot water faucet from which hot water is supplied.

11. A refrigerator having a dispenser, comprising:

a dispenser case mounted at one side of a refrigerator door;

faucets provided in the dispenser case from which water is supplied; and a dispenser door for opening and closing the dispenser case, wherein the dispenser door is provided with a base on which a cup or tool can be placed at the time of opening the dispenser door at an inner lateral surface thereof, and wherein the base is provided with a plurality of circular grooves having a certain depth at the inner lateral surface thereof.

12. The refrigerator of claim 11, wherein the dispenser door is rotatably coupled to a lower portion of the dispenser case by a coupling means in order to open and close the dispenser case upwardly and downwardly.

13. The refrigerator of claim 12, wherein the coupling means includes:

stopping grooves formed at inner wall surfaces of both sides of the dispenser case; and hinge protrusions protruded at outer wall surfaces of both sides of the dispenser door thus to be rotatably inserted into the stopping grooves of the dispenser case.

14. The refrigerator of claim 11, wherein a detachable protrusion is provided at an upper lateral surface of the dispenser door, and a detachable protrusion groove for mounting the detachable protrusion is provided at an inner wall of the dispenser case.

15. The refrigerator of claim 11, wherein the dispenser door and the dispenser case are provided with a fixation means so that the dispenser door can be fixed to the refrigerator door with an angle of 90° in a state that the dispenser door is opened.

16. The refrigerator of claim 15, wherein the fixation means includes:

guide grooves formed at inner wall surfaces of both sides of the dispenser case with a certain length and width; and supporting members having a certain length and of which one side is movably coupled to the guide groove and another side is rotatably coupled to a lateral surface of the dispenser door.

17. The refrigerator of claim 16, wherein the guide groove has a perpendicular longitudinal direction.

18. The refrigerator of claim 11, wherein the dispenser door is provided with a hand grip at an outer lateral surface thereof.

19. The refrigerator of claim 11, wherein the faucets consist of a cold water faucet from which cold water is supplied and a hot water faucet from which hot water is supplied.

* * * * *